United States Patent [19]

Adler et al.

[11] 4,351,310

[45] Sep. 28, 1982

[54] IGNITION COIL WITH OVERVOLTAGE PROTECTION CONNECTED TO THE SECONDARY WINDING OF THE IGNITION COIL

[75] Inventors: Karl-Heinz Adler, Leonberg; Georg Pfaff, Asperg; Reinhard Leussink, Bremen; Gerhard Söhner, Remshalden; Gerd Höhne, Ludwigsburg; Thomas Jökh, Korntal-Münchingen; Heinz Decker, Vaihingen Enz-Riet, all of Fed. Rep. of Germany

[73] Assignee: Robert Bosch GmbH, Stuttgart, Fed. Rep. of Germany

[21] Appl. No.: 193,186

[22] Filed: Oct. 1, 1980

[30] Foreign Application Priority Data

Oct. 3, 1979 [DE] Fed. Rep. of Germany ..... 2940070

[51] Int. Cl.[3] ..... F02P 11/00; F02P 1/00

[52] U.S. Cl. ..... 123/644; 123/630; 123/627

[58] Field of Search ..... 123/644, 627, 654, 630, 123/643; 324/126; 361/86, 91, 256, 263

[56] References Cited

U.S. PATENT DOCUMENTS

| | | | |
|---|---|---|---|
| 3,938,490 | 2/1976 | Snyder et al. | 123/644 |
| 3,949,722 | 4/1976 | Linstedt et al. | 123/644 |
| 4,114,582 | 9/1978 | Rabus et al. | 123/644 |
| 4,196,711 | 4/1980 | Daumer | 123/644 |
| 4,244,344 | 1/1981 | Werner et al. | 123/644 |
| 4,246,881 | 1/1981 | Bodig | 123/644 |
| 4,290,406 | 9/1981 | Iyoda et al. | 123/644 |

*Primary Examiner*—Raymond A. Nelli

*Attorney, Agent, or Firm*—Frishauf, Holtz, Goodman & Woodward

[57] ABSTRACT

An overvoltage protection circuit is galvanically, directly connected across at least part of the secondary winding in the ignition system of an internal combustion engine. The input portion of the overvoltage protection circuit is a voltage divider preferably constituted by RC elements. The voltage at the tap of the voltage divider is applied to a Schmitt trigger. When the voltage across the secondary winding becomes excessively high, the Schmitt trigger output pulse triggers a monostable multivibrator whose output pulse in turn increases the conductivity of a transistor switch located in series with the primary. The increase in primary current tends to oppose further increases in primary and secondary voltages. Alternatively, the output from the multivibrator could be used to shorten the time of current flow in the primary winding in subsequent ignition time intervals or to completely block any subsequent ignition process.

10 Claims, 1 Drawing Figure

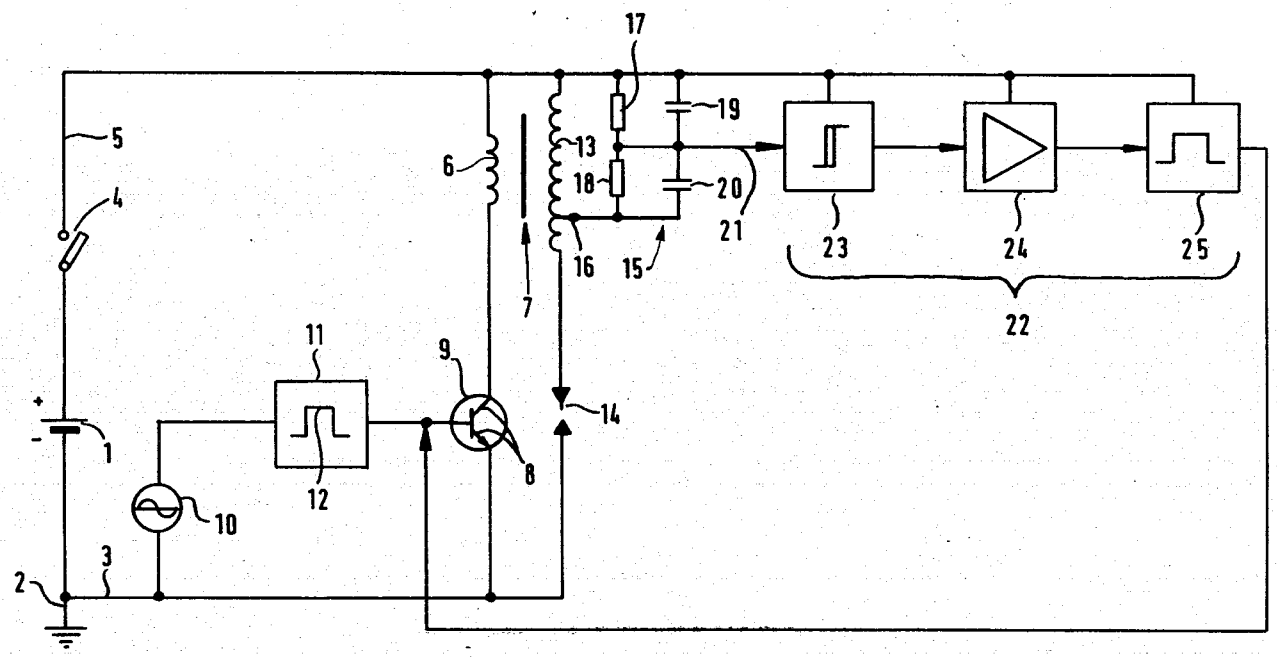
1
2
3
4
5
6
7
8
9
10
11
12
13
14
15
16
17
18
19
20
21
22
23
24
25
+
-

IGNITION COIL WITH OVERVOLTAGE PROTECTION CONNECTED TO THE SECONDARY WINDING OF THE IGNITION COIL

CROSS-REFERENCE TO RELATED PATENT

U.S. Pat. No. 3,949,722, Linsted et al., assigned to the assignee of this application.

The above-mentioned publication is incorporated into the present application by reference herein.

The present invention relates to ignition systems and, particularly, to ignition systems in automotive vehicles.

BACKGROUND

U.S. Pat. No. 3,949,722 discloses an ignition system which has an overvoltage protection for the ignition coil. However, in the system of this patent, the criterion for overvoltage is the maximum allowable voltage across the primary winding of the ignition coil. However, it has now been found that limiting the voltage across the primary winding of the ignition coil is not sufficient to prevent overvoltages across the secondary winding under certain conditions. For example, if there is a break in the line between the secondary of the ignition coil and the spark plug, the capacitance in the secondary circuit of the ignition coil decreases to such an extent that excess voltages can result in burning up insulation.

THE INVENTION

It is an object of the present invention to limit the voltage on the secondary side of the ignition coil so that the above-described problems cannot occur.

In accordance with the present invention, an overvoltage protection circuit is connected directly and galvanically to the secondary winding of the ignition coil, and across at least a part of the secondary winding of the ignition coil. Preferably, the overvoltage protection comprises at least one voltage divider and circuits responsive to the voltage at the tap of the voltage divider to control the current through the primary winding of the ignition coil. Thus, breaks in a connection line between the secondary of the coil and the spark plug will not result in high voltages.

DRAWING DESCRIBING A PREFERRED EMBODIMENT

The single FIGURE is a circuit diagram, partially in block form of the overvoltage protection circuit of the present invention as connected to the secondary winding of an ignition coil.

The ignition circuit shown in the single FIGURE is part of an internal combustion engine of a motor vehicle. The ignition system is supplied by a source of DC voltage 1 which, preferably, is the battery of the motor vehicle. Reference numeral 2 indicates a ground or chassis connection. The negative side of the battery is connected to reference point 2, while the positive side is connected through a switch 4 to a line 5. Further connected to reference potential is a supply line 3. The primary winding 6 of an ignition coil 7 has one end connected to line 5 and the other end connected to the emitter-collector circuit 8 of a transistor 9. The emitter of transistor 9 is connected to supply line 3. Transistor 9 is an electronic switch which controls current flow through primary winding 6. A contactless signal generator 10 is provided to control the ignition process. For the present case, it is assumed that signal generator 10 acts as a small AC generator. Signal generator 10 is connected to the input of a control stage 11 whose output is connected to the base of transistor 9. The rectangular pulses 12 in control stage 11 are to be a symbolic indication that switch 8 is conductive through the duration of pulses 12. Secondary winding 13 of ignition coil 7 has one terminal connected to line 5 and the other terminal connected to a spark plug 14 whose other side is connected to ground or chassis potential.

An overvoltage protection circuit 15 is directly, galvanically, connected to, i.e. across a part of secondary winding 13. Specifically, the input to the overvoltage circuit 15 is connected between a tap 16 of secondary winding 13 and line 5. The input circuit includes at least one voltage divider. In the simplest case, this includes two series connected resistors 17, 18, or two capacitors, 19, 20. Better results can, however, be obtained if both series resistor and series capacitor circuits are used. In the latter case, care must be taken that the charge and discharge time constants of the RC circuit including resistors 17 and capacitor 19 is the same as the charge and discharge time constant of the RC circuit 18, 20. The common point of resistors 17 and 18 and capacitors 19 and 20 is connected to a line 21 whose other end is connected to a control circuit 22. The input stage 23 of control circuit 22 is a threshold stage, preferably a Schmitt trigger. As shown in the figure, an amplifier 24 is connected to the output of Schmitt trigger 23. The amplified signal at the output of amplifier 24 is applied to a monostable multivibrator 25. The output pulse of monostable multivibrator 25 is, in turn, applied to the base of transistor 9.

OPERATION

When switch 4 is closed, the ignition system is ready to operate. As soon as signal generator 10 initiates the generation of rectangular pulses 12 at the output of stage 11, switch 8 is switched to the conductive state. This causes current to flow through primary winding 6 of ignition coil 7. This current flow is interrupted at the end of pulse 12, causing a high voltage pulse to be induced in secondary winding 13, thereby creating a spark at spark plug 14.

Before the high voltage pulse induced in secondary winding 13 reaches excessively high values, threshold circuit 23 is triggered. The output signal from Schmitt trigger 23, after amplification in amplifier 24 triggers monostable multivibrator 25. The output pulse from monostable multivibrator 25 causes the emitter-collector circuit of transistor 9 to have an increased conductivity. The increase in current flow through the primary winding opposes any increases in voltage across the primary winding and simultaneously opposes any increases in voltage across the secondary winding 13.

Use of the monostable multivibrator 25 allows the conductivity of the emitter-collector circuit of transistor 9 to stay at a relatively high value over at least a minimum time interval.

Control circuit 22 could of course also be used to effect a shortening of the pulse width of pulse 12 or to completely block the ignition process.

It is of course also possible that the overvoltage protection circuit be connected across the complete secondary winding, rather than just a portion thereof.

Various changes and modifications may be made within the scope of the inventive concepts.

Best mode known by the inventors:

Resistor 17: 10 Kiloohms
Resistor 18: 10 Megaohms
Capacitor 19: 10 Nanofarad
Capacitor 20: 20 Picofarad Time constant used for the monostable multivibrator 25:
500 Microseconds input voltage on the voltage divider 17/19, 18/20:
30 Kilovolts output voltage on the voltage divider 17/19, 18/20:
30 Volts.

We claim:

1. In an ignition system having an ignition coil (7) having a primary winding (6) and a secondary winding (13), and means (9) for interrupting the current through said primary winding at an ignition time, the improvement comprising an overvoltage protection circuit (15) directly, galvanically connected to the secondary winding (13) of the ignition coil (7);

and wherein said overvoltage protection circuit has an input circuit (17–20) solely connected directly in parallel across at least a part of said secondary winding.

2. An ignition system as set forth in claim 1, wherein the input circuit of said overvoltage protection circuit (15) comprises at least one voltage divider (17, 18; 19, 20).

3. An ignition system as set forth in claim 2, wherein said voltage divider comprises a first and second resistance (17, 18).

4. An ignition system as set forth in claim 3, wherein said voltage divider comprises at least a first and second capacitive reactance (19, 20).

5. An ignition system as set forth in claim 3, further comprising an additional voltage divider comprising at least a first and second capacitive reactance.

6. An ignition system as set forth in claim 5, further comprising circuit means (22) interconnected between said voltage divider and said current interrupt means for controlling said current interrupt means in dependence upon the voltage across at least part of said voltage divider means.

7. An ignition system as set forth in claim 6, wherein said circuit means is connected to the common point of said first and second resistance.

8. An ignition system as set forth in claim 7, wherein said common point of said first and second resistance is connected to the common point of said first and second capacitive reactance.

9. An ignition system as set forth in claim 1, wherein said current interrupt means comprises an electronic switch having a variable conductivity;

further comprising circuit means (22) connected between said overvoltage protection circuit and said electronic switch for changing the conductivity of said electronic switch in response to an overvoltage across said secondary winding.

10. An ignition system as set forth in claim 9, wherein said change in conductivity is an increase in conductivity.

* * * * *